US005758520A

United States Patent [19]

Hirano et al.

[11] Patent Number: 5,758,520

[45] Date of Patent: Jun. 2, 1998

[54] FABRIC TREATMENT APPARATUS

[75] Inventors: Tsukasa Hirano; Yoshihide Kitade; Hisashi Hasuta, all of Nomi-gun, Japan

[73] Assignees: Komatsu Seiren Co., Ltd.; Onomori Iron Works Co., Ltd., both of Ishikawa-ken, Japan

[21] Appl. No.: 605,165

[22] PCT Filed: May 29, 1995

[86] PCT No.: PCT/JP95/01028

§ 371 Date: Mar. 6, 1996

§ 102(e) Date: Mar. 6, 1996

[87] PCT Pub. No.: WO96/01919

PCT Pub. Date: Jan. 25, 1996

[30] Foreign Application Priority Data

Jul. 7, 1994 [JP] Japan ..... 6-155923

[51] Int. Cl.[6] ..... D06B 5/08

[52] U.S. Cl. ..... 68/6; 34/643; 68/5 D; 68/20; 68/181 R

[58] Field of Search ..... 68/5 D, 6, 20, 68/181 R, 355; 34/640, 643

[56] References Cited

U.S. PATENT DOCUMENTS

| | | | |
|---|---|---|---|
| 2,008,230 | 7/1935 | Spooner | 68/5 D |
| 4,290,210 | 9/1981 | Johansson | 34/643 |
| 4,796,557 | 1/1989 | Shibata et al. | 118/62 |
| 5,181,329 | 1/1993 | Devaney, Jr. et al. | 34/643 |
| 5,233,717 | 8/1993 | Weber et al. | 68/181 R X |

FOREIGN PATENT DOCUMENTS

| | | | |
|---|---|---|---|
| 645979 | 7/1964 | Belgium . | |
| 2015775 | 11/1971 | Germany | 68/20 |
| 26 23 671 | 12/1976 | Germany . | |
| 59-32637 | 9/1984 | Japan . | |
| 61-245357 | 10/1986 | Japan . | |
| 6-25394 | 4/1994 | Japan . | |
| 1144607 | 3/1969 | United Kingdom . | |

*Primary Examiner*—Philip R. Coe

*Attorney, Agent, or Firm*—Burns, Doane, Swecker & Mathis, L.L.P.

[57] ABSTRACT

A fabric treatment apparatus for the treatment of a textile fabric, over the full width, with a fluid, which comprises at least one fabric treatment means provided with side walls which form a treatment path which allows fabric to pass through at full width while surrounding it at a narrow spacing and at least one treatment fluid blowing means constructed on at least a section of the side walls which can blow a treatment fluid into the treatment path to cover the entire width of the fabric passing through the treatment path, wherein the narrow spacing of the treatment path is 30 mm or less, and both ends of the treatment path are open to the surrounding atmosphere which is not pressurized. It efficiently performs various treatments on fabric including washing, desizing, scouring, fluff removal, resin impregnation, drying, dewatering, feeling adjustment and dyeing.

13 Claims, 6 Drawing Sheets

FABRIC TREATMENT APPARATUS

TECHNICAL FIELD

The present invention relates to a fabric treatment apparatus. More specifically, it relates to an apparatus suitable for efficiently performing various treatments on textile fabrics, such as washing, desizing, scouring, resin impregnation, drying, dewatering, hand adjustment, dyeing, fluff removal, and the like.

BACKGROUND ART

Common continuous treatment methods for washing, etc. of textile fabric include a method in which a plurality of guide rollers are arranged in a zig-zag pattern in a treatment bath and the fabric is guided through at full width (hereunder referred to as the "guide roller method"), and a process in which the fabric is introduced into the treatment apparatus in the form of a rope, passed through a treatment bath, roller, reel, jet nozzle, etc., circularly transported in a spiral shape through first, second, third, and additional successive rows in the apparatus, and then taken out of the apparatus (hereunder referred to as the "continuous winch process"). Japanese Patent Publication No. 4-501892 discloses, as a method for continuous treatment of fabric to be washed, etc., one wherein the fabric is passed at full width through a vertical path, and a treatment medium is blown into the path in the form of vapor or gas to treat the fabric while producing turbulence under pressure.

On the other hand, as methods of continuous dewatering treatment of fabric at full width, there may be mentioned a method in which the fabric is passed through rollers, and pressure is applied to the rollers to nip and dewater the fabric (nip roll method), or a method in which the suction nozzle of a vacuum pump is contacted with the fabric to draw out moisture, etc. from the fabric to dewater it (vacuum dewatering method).

Desizing washing of printed fabric involves reductive washing in an aqueous alkali solution for removal of printing paste and improvement in dye fastness. For an improved washing effect, the fabric must be washed by thorough contact with the washing water while providing a rubbing effect, but without exerting tension.

The guide roller method described above has the advantage of good workability in treating fabric at full width, and also of low color contamination, etc. which is a problem associated with desizing washing of prints. However, since the freedom of the fabric in the treatment bath is restricted it often occurs that almost no rubbing effect is achieved, resulting in insufficient washing in the treatment solution, while tension also acts on the fabric to result in an inferior hand. In addition, because of other possible problems such as small fabric-holding capacity of the treatment bath, this method is not often used for desizing washing of prints.

The continuous winch process has the advantage of allowing extended contact between the fabric and the washing water, and producing a rubbing effect by movement within the bath without exerting tension on the fabric, and thus it is presently the main method used for desizing washing of printed fabrics. However, since this method treats the fabric in rope form, the fabric can become "dumpling-shaped" during the circular transport into a spiral shape, leading to working problems so that the fabric can no longer be transported, etc., as well as other problems including color contamination inside the rope.

The method in Japanese Patent Re-Publication (Kohyo) No. 4-501892, whereby fabric is treated by blowing vapor or the like from a nozzle into a vertical path to create turbulence in the path under pressure, thus exerts excessive force on the fabric, which can incurring damage to the fabric. Also, the apparatus disclosed in this document requires considerable structural strength and is therefore costly.

The nip roll method and vacuum dewatering method for continuous dewatering treatment of fabric involve contacting the fabric with a roller or suction nozzle, and thus can result in flow and friction marks on the fabric.

DISCLOSURE OF THE INVENTION

It is therefore an object of the present invention to overcome the aforementioned disadvantages of the prior art by providing an apparatus capable of more efficiently performing various treatments on textile fabrics, such as washing, desizing, scouring, resin impregnation, drying, dewatering, hand adjustment, dyeing, fluff removal, and the like.

In order to attain the above-mentioned object, the present invention provides a fabric treatment apparatus for treatment of textile fabric at full width, which comprises at least one fabric treatment means provided with side walls which form a treatment path which allows fabric to pass through at full width while surrounding it at a narrow spacing, and at least one treatment fluid blowing means constructed on at least a section of each side wall which can blow a treatment fluid into the treatment path to cover the entire width of the fabric passing through the treatment path, wherein the narrow spacing of the treatment path is 30 mm or less, and both ends of the treatment path are open to the surrounding atmosphere which is not pressurized.

BEST MODE FOR CARRYING OUT THE INVENTION

Figure 1:
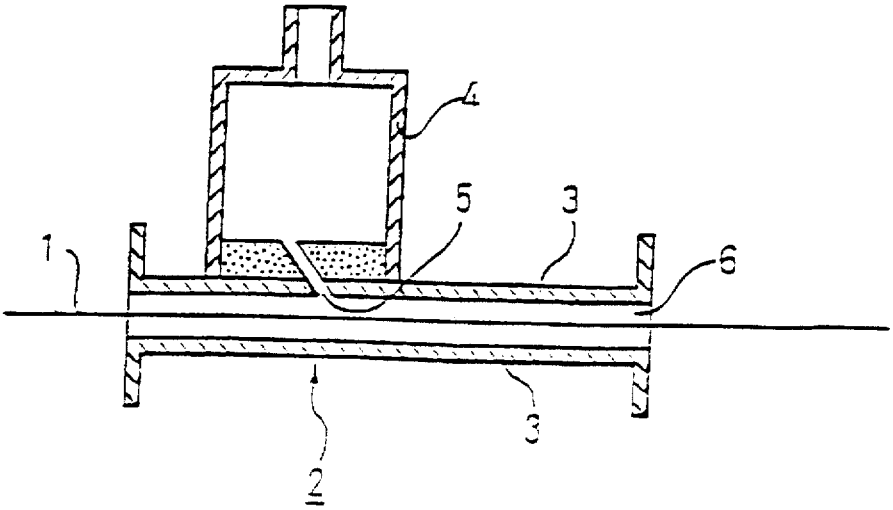
FIG. 1 is a schematic cross-sectional view of an embodiment of the fabric treatment means used in a treatment apparatus according to the invention.

The apparatus of the present invention utilizes the vibration applied to the fabric by the action of the fluid blown in from the nozzle in the fabric treatment means. This principle makes use of vibrational energy supplied to the fabric to allow easy removal of contaminants, sizing agents, unfixed dyes, fats and oils, fluffs and the like (hereunder referred to collectively as "various contaminants") clinging to the fabric, and to also allow more easy removal of these various contaminants in liquid treatment media such as water or chemicals, or solid treatment media. The vibration applied to the fabric also accomplishes dewatering of the fabric by blowing off moisture present in the fabric. Furthermore, since both ends of the treatment path in the apparatus of the invention are open to the surrounding atmosphere which is not pressurized, no unnecessary super-atmospheric pressure or negative pressure is applied inside the treatment path, and consequently problems of treatment defects caused by excessive force exerted on the fabric are virtually non-existent, while the apparatus has a more economical construction.

In the apparatus of the invention, the narrow spacing of the fabric treatment path of the fabric treatment means, i.e. the spacing between the side walls situated on both the front and back of the fabric passing through the treatment path, is preferably no greater than 10 mm, and most preferably no greater than 5 mm, from the standpoint of applying sufficient vibration to the fabric. According to the present invention, the treatment fluid blown in from the treatment fluid blowing means may be directly blown onto the fabric at a desired angle, or it may be blown into the space between the fabric and the side walls.

According to the invention, at least one treatment fluid blowing means is provided on each of the side walls situated on both the front and back of the fabric passing through the treatment path, and they are preferably situated so that the treatment fluid blown in from each of the blowing means works in different lengthwise directions on the front and back sides. This aids in vibration of the fabric, and also aids in the treatment effect since minute vibrations are more suitable for efficient treatment.

If desired, 2 or more of the fabric treatment means described above may be connected in a continuous treatment path. This further aids in the treatment effect.

According to the present invention, the above-mentioned treatment fluid is usually a gas such as air or vapor of water or another liquid. Alternatively, if desired, the treatment fluid may be a liquid treatment medium such as a washing liquid, scouring liquid or other treatment agent, or a granular solid treatment medium such as abrasive grains, and a spray containing such a liquid or solid treatment medium may be used to further increase the efficiency of washing treatment, etc. of the fabric. In addition, when 2 or more treatment fluid blowing means are provided, different types of treatment fluid may be blown in from different blowing means. Examples of various possible combinations include a gas/gas combination of air and water vapor, etc., a gas/liquid combination of air or water vapor, etc. and a washing or scouring liquid, as well as gas/solid, liquid/liquid, liquid/solid and solid/solid combinations. Such a procedure allows greater efficiency for the desired treatment, since multiple types of treatment may be simultaneously performed.

For adequate vibration of the fabric in the treatment path, the blowing rate for the treatment fluid blown in from the nozzle of the blowing means is preferably 30 m/sec or greater, and if necessary even 300 m/sec or greater. Of course, this rate is not particularly restricted, and may be appropriately selected depending on the type of treatment fluid and the purpose of treatment.

The treatment apparatus of the invention not only performs very efficient treatment of fabric including washing, desizing, scouring, fluff removal, dewatering, drying, etc. by the procedure described above, but also efficiently performs other types of treatment such as impregnation of resins, hand adjustment, dyeing, and the like. The apparatus may also be connected to the treatment path of a conventional washing, scouring or drying apparatus, to thus realize greater treatment efficiency and improvement in the treatment effect, hand, etc.

Embodiments of apparatuses according to the invention are explained below with reference to the attached drawings.

FIG. 1 is a schematic cross-sectional view of an embodiment of the fabric treatment means used in a treatment apparatus according to the invention. In this fabric treatment means 2, the treatment path 6 is formed so that the side walls 3 surround the full-width fabric 1 at a narrow spacing of 30 mm or less, treatment fluid blowing means 4 is provided on a section of a side wall 3 to blow in the treatment fluid from one side of the treatment path 6, and both ends of the treatment path are open. The fabric 1 is guided at full width into the entry opening of the treatment path 6, and while passing through the treatment path it is vibrated by the action of the treatment fluid blown into the treatment path from the blowing inlet 5 of the treatment fluid blowing means 4, and then discharged from the exit opening of the treatment path 6 while the vibration is continued. The blowing inlet 5 of the treatment fluid blowing means 4 runs along the transverse direction of the treatment path 6, so that the treatment fluid blown therefrom works on the entire width of the fabric.

Figure 2:
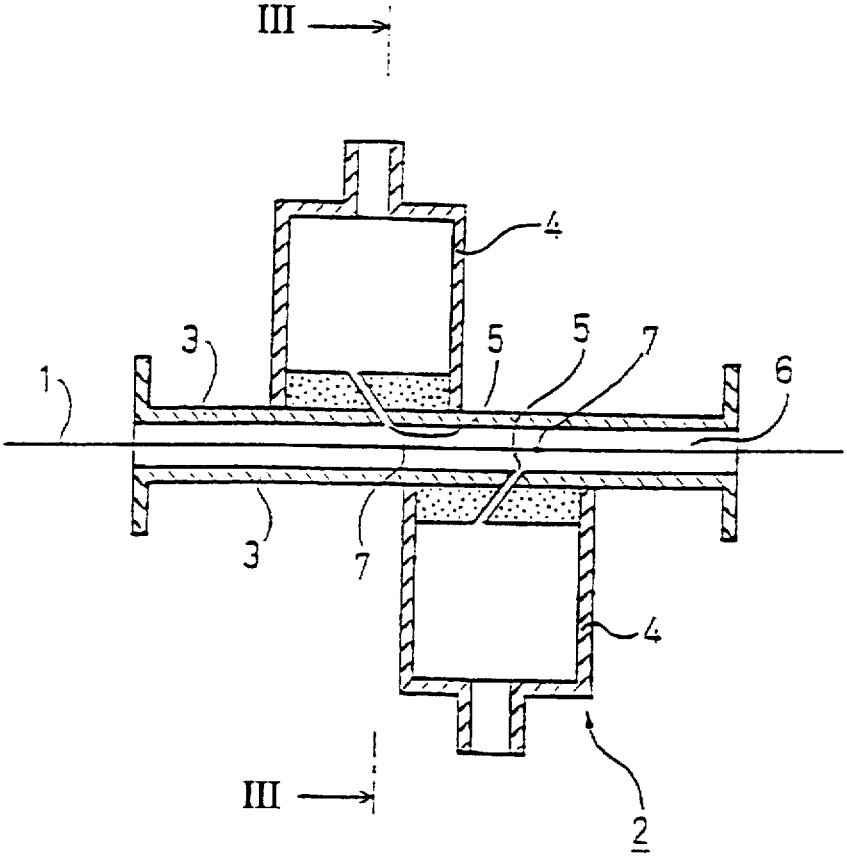
FIG. 2 is a schematic cross-sectional view of another embodiment of the fabric treatment means used in a treatment apparatus according to the invention.
Figure 3:
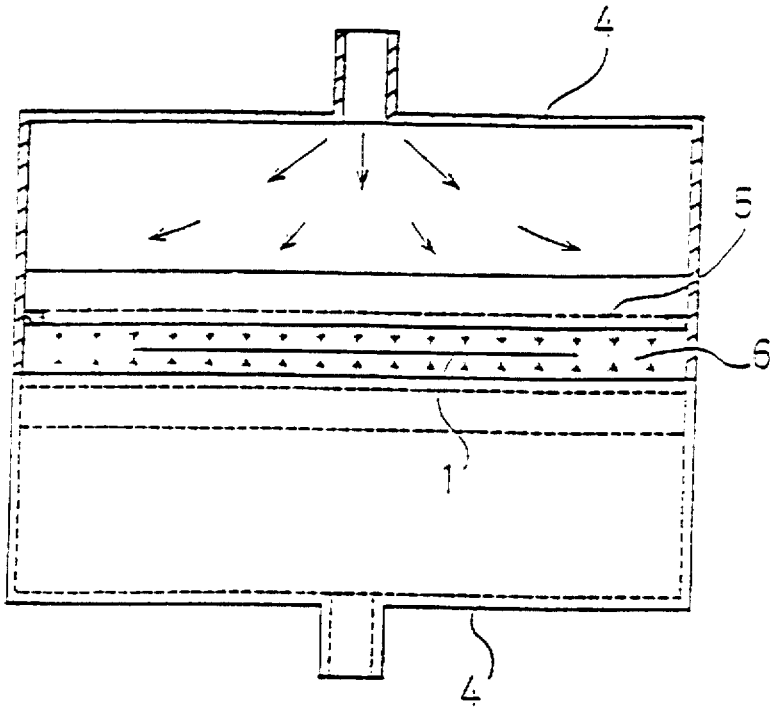
FIG. 3 is a cross-sectional view of the apparatus in FIG. 2 taken along line III—III.

FIG. 2 is a schematic cross-sectional view of another embodiment of the fabric treatment means used in a treatment apparatus according to the invention, and FIG. 3 is a cross-sectional view of the apparatus in FIG. 2 taken along line III—III. This fabric treatment means 2 has almost the same construction as the fabric treatment means shown in FIG. 1, except that separate treatment fluid blowing means 4 are provided on each of the side walls 3 at staggered positions. In this apparatus, the treatment fluid works on the fabric passing through the treatment path 6 at two working points 7, so that the vibration of the fabric is further assisted. The arrows in FIG. 3 indicate the flow of the treatment fluid.

Figure 4A:
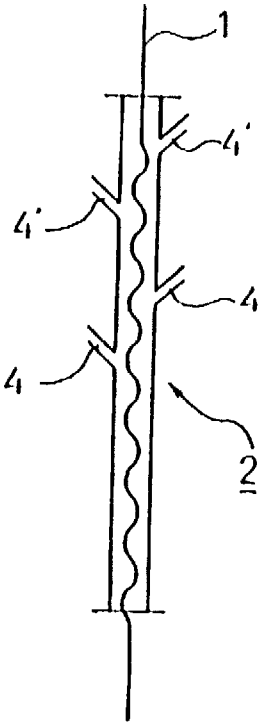
FIGS. 4N–4D is a set of schematic views of yet another embodiment of the fabric treatment means used in a treatment apparatus according to the invention.
Figure 4B:
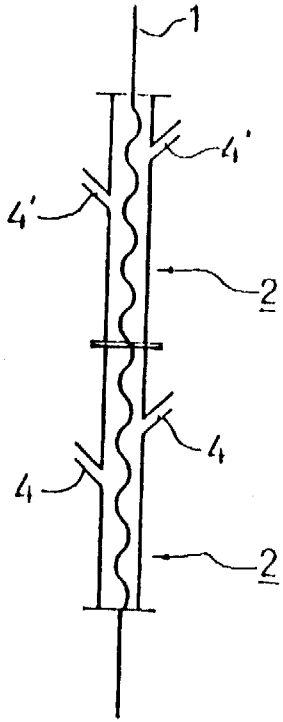
Figure 4C:
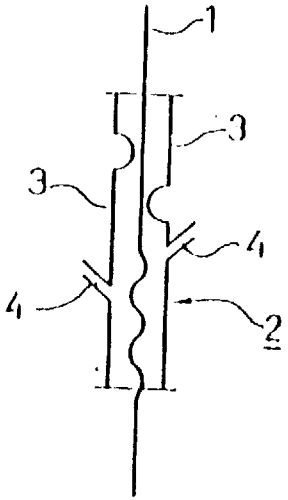
Figure 4D:
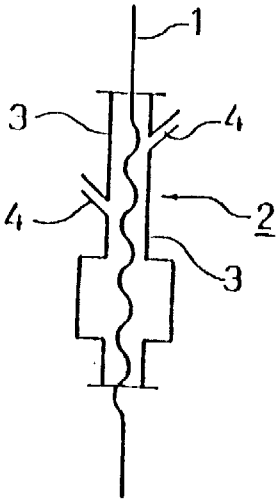

FIGS. 4A through 4D are schematic views of other embodiments of the fabric treatment means used according to the invention. The apparatus in FIG. 4A is provided with two separate treatment fluid blowing means 4, 4' on each side of the treatment path, at alternating staggered positions. In this apparatus, vibration of the fabric is further assisted. An identical treatment apparatus may also be obtained by connecting two of the apparatuses shown in FIGS. 2 and 3 in series. That is, such an apparatus would have the construction shown in FIG. 4B. FIGS. 4C and 4D show apparatuses in which the shapes of the walls are changed to provide recesses or protrusions on sections of the side walls 3. Such constructions create even greater turbulence of the treatment fluid in the treatment path, to thus exert more vigorous vibrations on the fabric.

Figure 5:
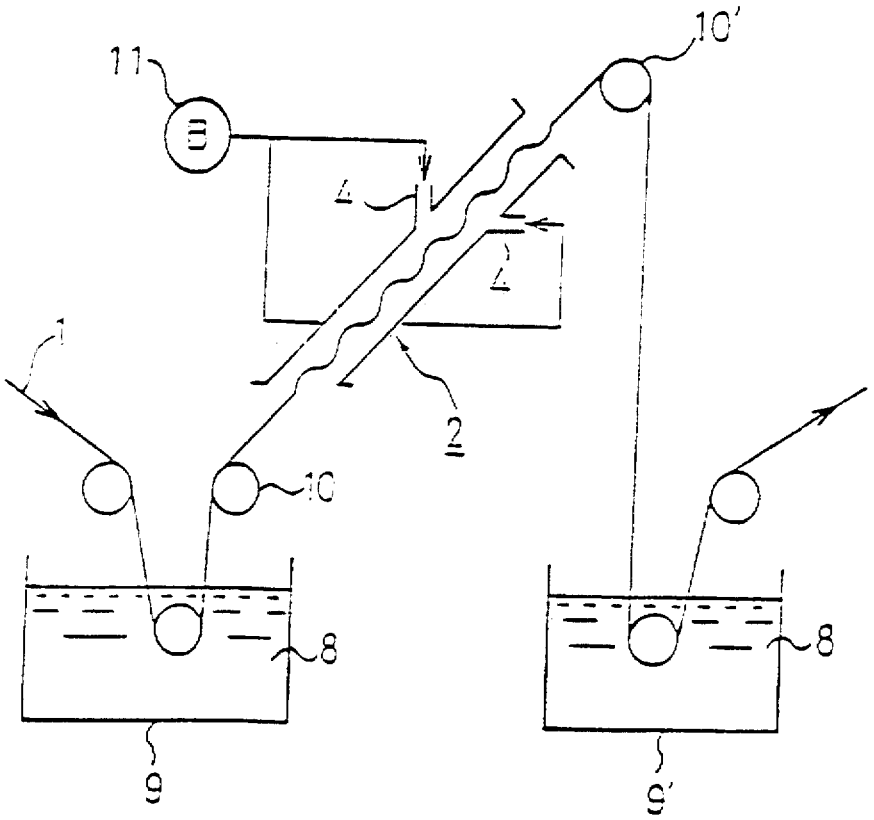
FIG. 5 is a schematic view of an example of a treatment apparatus according to the invention which is applied to fabric washing treatment.

FIG. 5 is a schematic view of an example of a fabric washing apparatus which incorporates a fabric treatment means 2 according to the invention as a single unit. For the treatment, the fabric 1 is first guided into a treatment bath 9 filled with a washing solution 8. The fabric is saturated with the washing solution as it passes through the treatment bath. The fabric is then fed by a guide roller 10 into the fabric treatment means 2, and while passing through the treatment path 6 it is vibrated by air blown in from a blower 11 through the treatment fluid blowing means 4, after which it is sent out from the exit opening of the treatment path to another guide roller 10'. The fabric is then guided from the guide roller 10' to another treatment bath 9' filled with washing solution 8.

Figure 6:
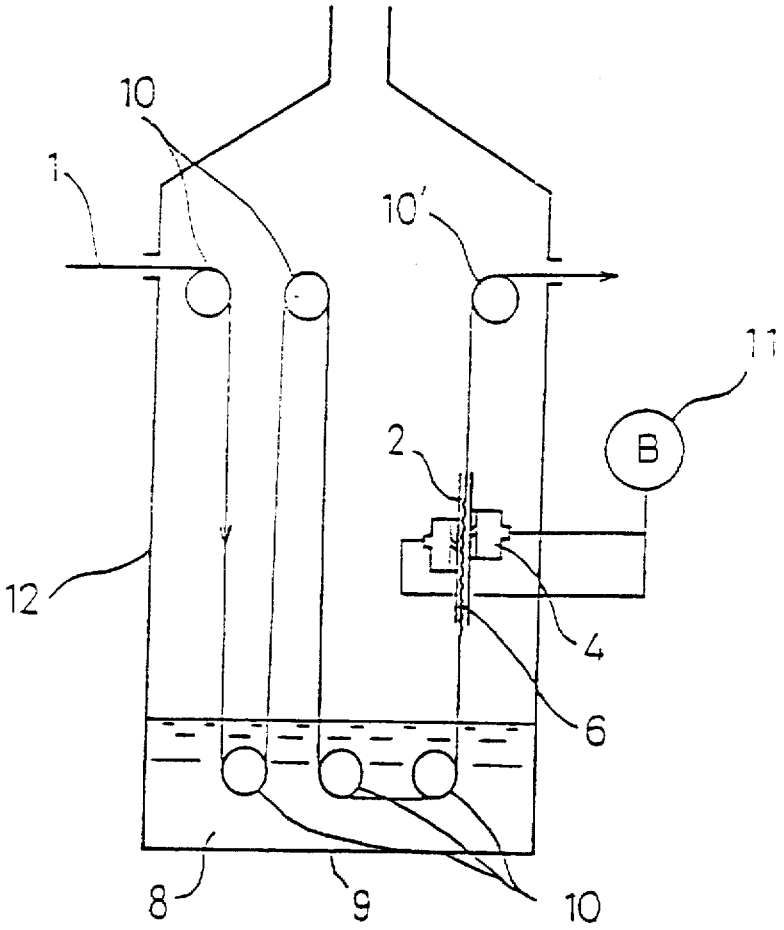
FIG. 6 is a schematic view of another example of a treatment apparatus according to the invention which is applied to fabric washing treatment.
Figure 7:
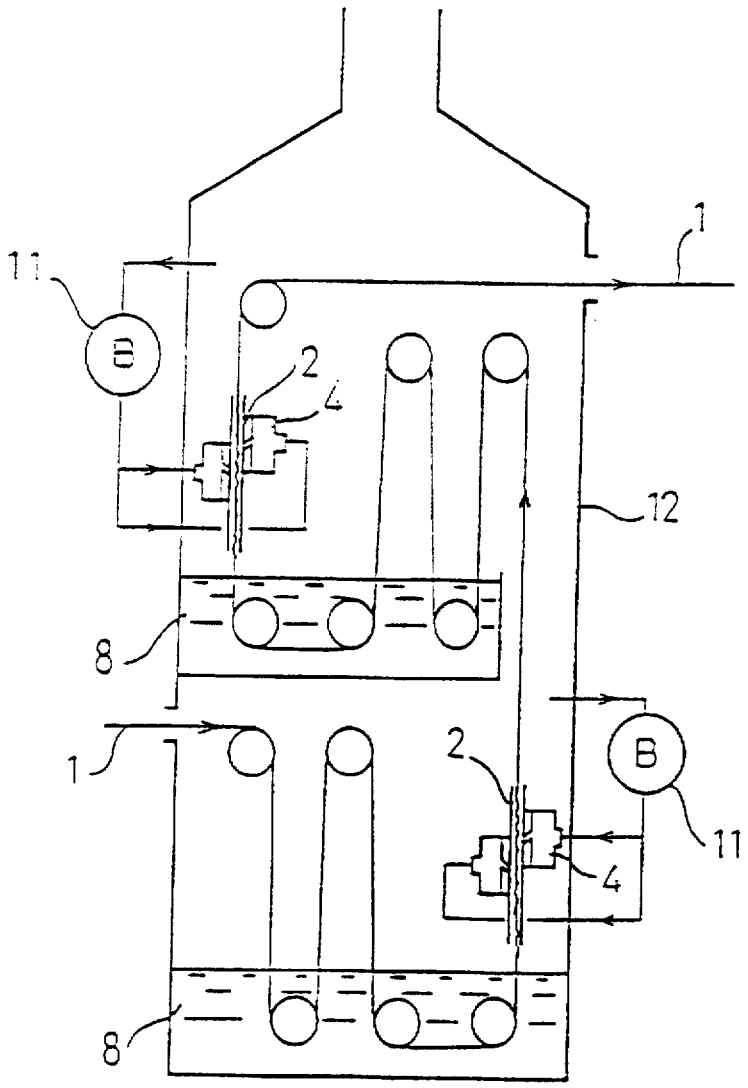
FIG. 7 is a schematic view of yet another example of a treatment apparatus according to the invention which is applied to fabric washing treatment.

FIGS. 6 and 7 are schematic views of other examples of treatment apparatuses according to the invention which are applied to fabric washing treatment. In FIG. 6, a fabric treatment means 2 having the construction shown in FIGS. 2 and 3 is incorporated into a guide roller treatment apparatus 12. The fabric 1 first enters into the guide roller treatment apparatus 12, and then it is transported through a plurality of guide rollers 10 which guide it into a treatment bath 9 filled with washing solution 8, so that it passes through the washing solution. The fabric is saturated with the washing solution as it passes, and it is then fed to the fabric treatment means 2 where it is vibrated while passing through the treatment path 6 by air blown in from a blower 11 through the treatment fluid blowing means 4, after which it is sent out from the exit opening of the treatment path to another guide roller 10'.

The apparatus in FIG. 7 is a modification of the apparatus in FIG. 6, which has the same construction as the apparatus in FIG. 6 except that two fabric treatment means 2 are incorporated into the guide roller treatment apparatus 12, and the atmosphere in the treatment apparatus 12 is circulated and blown into the treatment paths 6 from the blowers 11 through the treatment fluid blowing means 4 of the fabric treatment means 2.

The aforementioned apparatuses shown in FIGS. 5 to 7 are very useful as fabric fluff removal apparatuses. Most fluff clinging to the fabric 1 is blown off at the fabric entry opening of the fabric treatment means 2, along with part of the treatment solution 8 with which the fabric is saturated, and falls down into the treatment bath 9. This very effectively removes fluffs from the fabric. In this case, at least one of the fluids blown into the fabric treatment means is preferably a gas, especially air.

INDUSTRIAL APPLICABILITY

The apparatus of the present invention efficiently performs various treatments on fabric including washing, desizing, scouring, fluff removal, dewatering, drying, resin impregnation, hand adjustment and dyeing, and provides improvements in the effects of such treatments and in the hand of the fabric.

We claim:

1. A fabric treatment apparatus for the treatment of textile fabric over the full width, comprising at least one fabric treatment means provided with side walls which form a treatment path which allows fabric to pass upward through the treatment path at full width while surrounding the fabric at a narrow spacing, and at least one treatment fluid blowing means provided on each of said side wall situated on front and back sides of the fabric passing through the treatment path of blow a treatment fluid into said treatment path to cover the entire width of the fabric passing through said treatment path, the at least one treatment fluid blowing means provided on each side wall being situated so that the treatment fluid blown in from each blowing means works at different positions on the fabric in the lengthwise direction of the fabric on the front and back sides of the fabric and works obliquely downward on the fabric at an angle, wherein the narrow spacing of said treatment path is 30 mm or less, and both ends of said treatment path are open to the surrounding atmosphere which is not pressured.

2. An apparatus according to claim 1 wherein 2 or more of said fabric treatment means are connected to make each treatment path continuous.

3. An apparatus according to claim 2, wherein said treatment fluid is a gas.

4. An apparatus according to claim 2, wherein said treatment fluid is a liquid or a granular solid.

5. An apparatus according to claim 2, wherein said treatment fluid is a spray containing a liquid or solid treatment medium.

6. An apparatus according to claim 1, wherein said treatment fluid is a gas.

7. An apparatus according to claim 1, wherein said treatment fluid is a liquid or a granular solid.

8. An apparatus according to claim 1, wherein said treatment fluid is a spray containing a liquid or solid treatment medium.

9. An apparatus according to claim 8, which contains, in addition to said fabric treatment means, a treatment bath and fabric guiding means comprising a plurality of guide rollers, and the fabric is fed by said fabric guiding means through a treatment liquid in said treatment bath and into the treatment path of said fabric treatment means.

10. An apparatus according to claim 1, which contains, in addition to said fabric treatment means, a treatment bath and fabric guiding means comprising a plurality of guide rollers, and the fabric is fed by said fabric guiding means through a treatment liquid in said treatment bath and into the treatment path of said fabric treatment means.

11. An apparatus according to claim 10 for washing treatment of textile fabric, wherein said treatment liquid is a washing liquid.

12. An apparatus according to claim 10, wherein 2 or more of said fabric treatment means are connected to make each treatment path continuous.

13. An apparatus according to claim 1 for fluff removal treatment of textile fabric, wherein a gas is blown in from at least one of said treatment fluid blowing means.

* * * * *